US011482167B1

(12) United States Patent
Kuang et al.

(10) Patent No.: US 11,482,167 B1
(45) Date of Patent: Oct. 25, 2022

(54) SYSTEMS AND METHODS FOR AMBIENT LIGHT SENSOR DISPOSED UNDER DISPLAY LAYER

(71) Applicant: Meta Platforms Technologies, LLC, Menlo Park, CA (US)

(72) Inventors: Jiangtao Kuang, San Jose, CA (US); Zhang Jia, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/400,027

(22) Filed: Aug. 11, 2021

(51) Int. Cl.
*G09G 3/3208* (2016.01)

(52) U.S. Cl.
CPC ..... *G09G 3/3208* (2013.01); *G09G 2310/08* (2013.01); *G09G 2320/029* (2013.01); *G09G 2320/0626* (2013.01); *G09G 2320/0693* (2013.01); *G09G 2360/141* (2013.01); *G09G 2360/144* (2013.01); *G09G 2360/16* (2013.01)

(58) Field of Classification Search
CPC ..... G09G 3/3208; G09G 2310/08; G09G 2320/029; G09G 2320/0626; G09G 2320/0693; G09G 2360/141; G09G 2360/144; G09G 2360/16
See application file for complete search history.

(56) References Cited

U.S. PATENT DOCUMENTS 9,449,561 B1 * 9/2016 Umansky ..... G09G 5/003
2013/0328842 A1 * 12/2013 Barnhoefer ..... G06F 3/0443 345/207

FOREIGN PATENT DOCUMENTS

CN 112017615 A * 12/2020
CN 112599089 A * 4/2021
WO WO-2020148451 A1 * 7/2020 ..... G01J 1/4204

* cited by examiner

*Primary Examiner* — Kenneth Bukowski
(74) *Attorney, Agent, or Firm* — Freestone Intellectual Property Law PLLC; Aaron J. Visbeek

(57) ABSTRACT

Systems and methods for an ambient light sensor (ALS) disposed under a display layer. In some implementations, an ALS reading is adjusted by compensating for light leakage in a display environment. In some aspects, a display leakage component may be determined based on image content driven onto a display pixel array during the ALS reading. An ambient light measurement may be generated by subtracting the display leakage component from the ALS reading and then adjusting a display brightness of the display pixel array in response to the ambient light measurement.

15 Claims, 7 Drawing Sheets

SYSTEMS AND METHODS FOR AMBIENT LIGHT SENSOR DISPOSED UNDER DISPLAY LAYER

TECHNICAL FIELD

This disclosure relates generally to display devices, and in particular to light sensors.

BACKGROUND INFORMATION

Ambient light sensors are used in, e.g., smartphones, televisions, laptops, and other devices, to adjust display brightness based on light conditions in the environment. Ambient light is measured in terms of illuminance using an International System of Units (SI) unit called the Lux, which is equal to one lumen per square meter. The lumen is a unit of luminous flux, a measure of the quantity of visible light emitted per unit of time. Thus, more lumens equate to a brighter light and less lumens equate to a dimmer light. Dimming and brightness control of a display screen improves user experience as well as saves power, extending battery life of the device. Proper adjustment of display light, however, may depend upon ambient light sensor measurements, which may not always be reliable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Embodiments of systems and methods for an ambient light sensor (ALS) disposed under a display layer are described herein. In embodiments, the systems and methods are directed to adjusting a display brightness in response to an ALS measurement that compensates for a display leakage component. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As noted above, ambient light sensors may be used to adjust display brightness based on ambient light conditions. In embodiments, the ALS may be located proximal to a display pixel array to capture ambient light sensor readings of a display environment. Light leakage from the display, e.g., a display pixel array, however, may invalidate ALS readings. For example, as shown in connection with FIGS. 2A and 2B, in an embodiment where the ALS is located behind the display, light from the display pixels (also referred to as "pixels") may leak and/or scatter, leading to an incorrect ALS reading and an overcompensated adjustment. Accordingly, an apparatus, system, and method for generating an ambient light measurement which compensates for a display leakage component in an ALS reading is described.

In embodiments, the system and methods include determining a display leakage component based on image content driven onto the display pixel array during the ALS reading. As described below, the display brightness of the display pixel array is then adjusted in response to the ambient light measurement.

Figure 1:
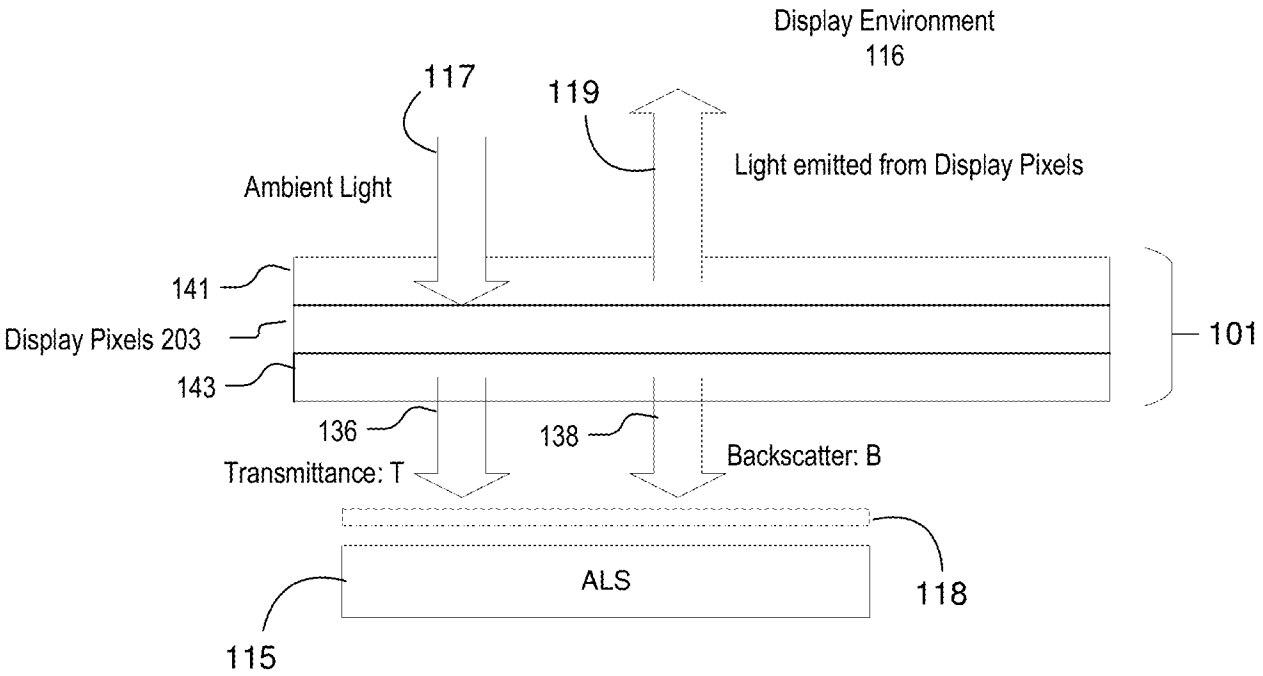
FIG. 1 is a simplified side view of an ambient light sensor (ALS) disposed under a portion of a display layer, in accordance with aspects of the disclosure.

FIG. 1 is a simplified side view of an ambient light sensor (ALS) disposed under a portion of a display layer, in accordance with aspects of the disclosure. In FIG. 1, an ALS 115 is disposed under display layer 101 and is configured to measure ambient light of a display environment 116. In the implementation shown, display layer 101 may include display pixels 203 located between a top layer 141 (or top substrate) and a bottom substrate or bottom layer 143. As shown, ambient light 117 may be transmitted from display environment 116 through bottom layer 143 to be sensed by ALS 115. In some aspects, light which reaches ALS 115 through, e.g., display layer 101, may be denoted as transmittance, T, at arrow 136. As shown, display pixel light 119 (e.g., OLED-emitted display pixel light displaying an image) is emitted away from ALS 115 and backscatter, B, may direct light back toward ALS 115 (e.g., arrow 138) from/through bottom layer 143. In some embodiments, Measured ALS Light from an ALS Reading=(T*Ambient Light)+(B*Display Pixel Light).

As shown, in some implementations, a numerical aperture (NA)-limiting layer 118 is located between ALS 115 and bottom layer 143. In some aspects, NA-limiting layer 118 may limit a range of incident angles over which ALS 115 accepts light. For example, NA-limiting layer 118 may include a fiber-optic plate or other suitable layer or material that limits light which reaches ALS 115 to a particular range of incident angles. The NA-limiting layer may limit backscatter or crosstalk from light emitted from display pixels that may not be proximal to a center pixel over ALS 115. In some aspects, eliminating noise helps in calibration of pixel weighting maps, which are discussed in connection with FIGS. 5A and 5B.

Note that in various embodiments, an adhesive material (not shown) that is located on or around bottom layer 143 having a refractive index substantially matched to bottom substrate 143 may be used to absorb light that may have traveled through various layers or substrates into an area proximal to ALS 115. Similar to the NA-limiting layer, the adhesive material may limit backscatter or noise in readings taken by ALS 115.

Note that ALS 115 may include any suitable light sensor, e.g., photodetector of known technology (such as but not limited to, photodiode, phototransistor, or photonic integrated circuit and the like) that can detect ambient light of display environment 116.

Figure 2B:
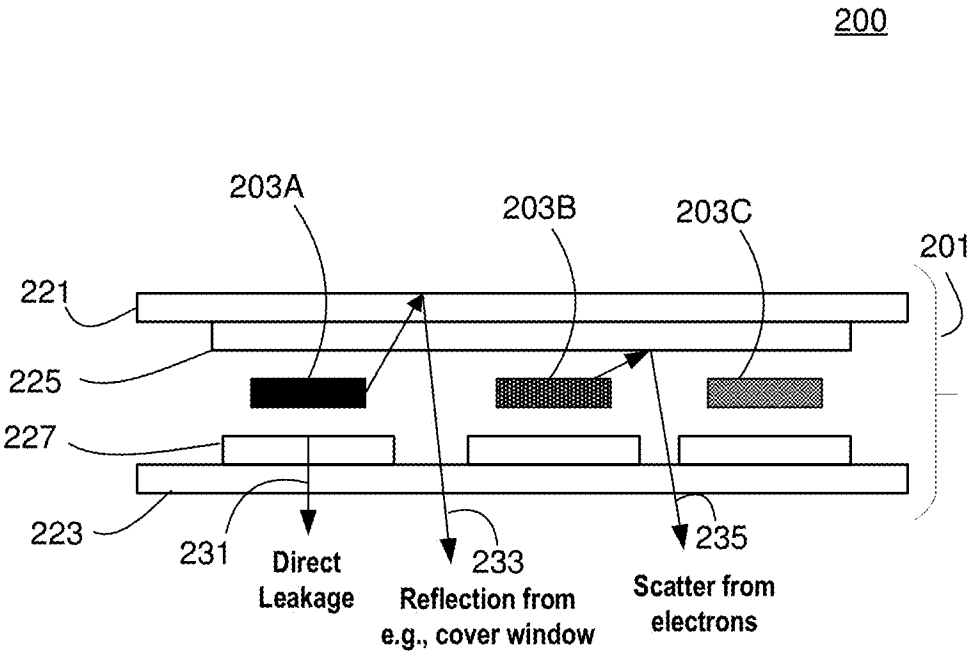
FIGS. 2A and 2B illustrate a respective top down and side view of a portion of an example display pixel array, in accordance with aspects of the disclosure.
Figure 2A:
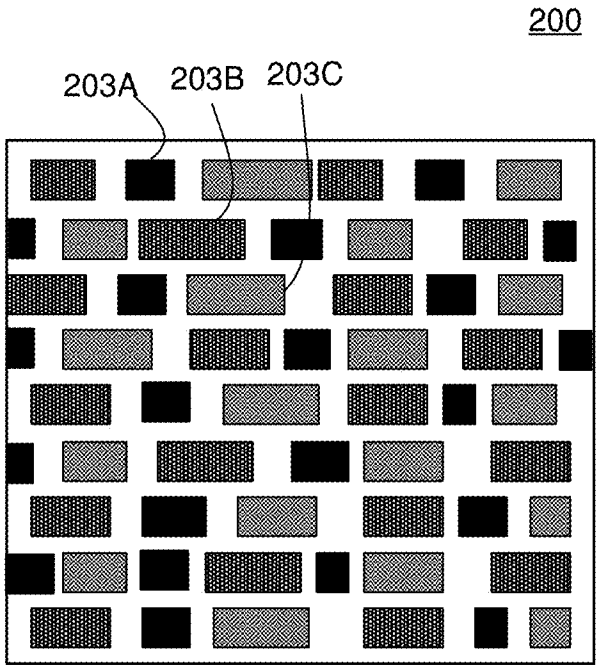

FIGS. 2A and 2B illustrate a respective top down and side view of a portion of an example display pixel array, in accordance with aspects of the disclosure. Example display pixel array 200 of FIGS. 2A/2B may be included in a display layer 201 that is similar to display layer 101 of FIG. 1. In some aspects, display pixel array 200 generates light and includes a plurality of red, green, and blue display pixels, e.g., a red display pixel 203A, green display pixel 203B, and blue display pixel 203C. In some implementations, the display pixels are organic light emitting pixels (OLED) pixels.

FIG. 2B illustrates a side view of a portion of example display pixel array 200. As shown, display pixel array 200 includes a display layer 201 including, e.g., display pixels 203A-203C between a top substrate 221 and a bottom substrate 223 (similar to or included in top and bottom layers 141 and 143 of FIG. 1). As shown in the FIG., display pixels 203A, 203B, and 203C are coupled to a top electrode 225 and bottom electrodes 227 (only one is labeled in the FIG.). In the example, as labeled in FIG. 2B, the arrows 231, 233, and 235 illustrate example light leakage paths from the display pixels. As noted above and as shown by arrow 231 in FIG. 2B, light from the display pixels, e.g., 203A, may leak directly through bottom substrate 223 to be captured or sensed by an ALS (e.g., ALS 115 of FIG. 1). Light may also reflect from top substrate 221 or layer above the display pixels, e.g., a cover window or glass, to be captured or sensed by the ALS (e.g., arrow 233). The display pixels, e.g., display pixel 203B, may also be a source of scatter from electrons interacting with electrodes 225, 227 or wiring routing of the display pixels, as indicated by arrow 235.

Note that the configuration of display pixel array 200 is merely one example of a display pixel array that can benefit from the system and methods described herein for generating an ambient light measurement. Display pixel array 200 illustrates a simplified OLED display pixel array. In other embodiments, other display pixel technologies such as liquid crystal display, micro LEDs, or quantum dots may be used as the display pixel array 200. In embodiments, the display may be of any suitable technology, where an ALS reading may benefit from compensation for a display leakage component that can be determined at least in part from red, green, and blue (RGB) components of image content.

Figure 3:
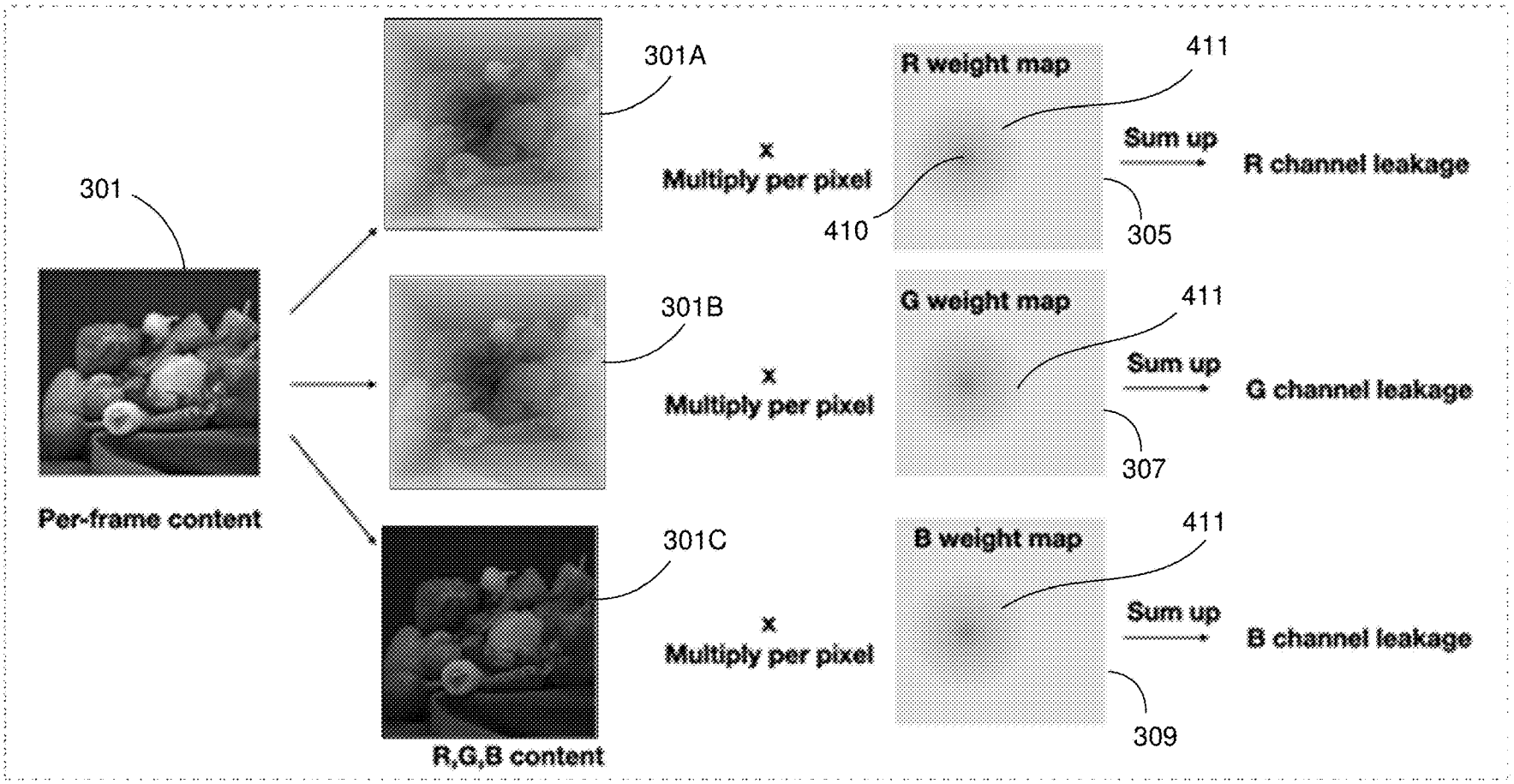
FIG. 3 illustrates an example process associated with determining a display leakage component associated with a display pixel array, in accordance with aspects of the disclosure.

FIG. 3 illustrates an example process associated with determining a display leakage component associated with a display pixel array, in accordance with aspects of the disclosure. FIG. 3 illustrates a frame of image content 301, which is composed of red components 301A, green components 301B, and blue components 301C. In the example, image content 301 is to be driven onto a display pixel array, e.g., display pixel array 400 of FIG. 4, described below, during an ALS reading. Display pixel array 400 of FIG. 4 has Pn number of display pixels arranged in X columns and Y rows. In embodiments, display processing logic 408 drives image content 301 onto display pixel array 400.

In embodiments, an ALS service (e.g., ALS service 601 discussed in connection with FIG. 6) analyzes image content 301 to determine red, green, and blue content or RGB components (301A, 301B, 301C), which are then multiplied by a corresponding weight from a pixel weighting map (e.g., red weight map 305, green weight map 307, and blue weight map 309). In aspects of the disclosure, the pixel weighting maps assign different weights to the red, green, and blue components based on a relative response from the ALS (e.g., ALS 115 of FIG. 1). For example, if the ALS is located under a display pixel 410 ("center pixel 410") and portions of image content 301 surrounding display pixel 410 includes primarily red components (e.g., a red pepper), a nearby display pixel 430 having a primarily red value will have a relatively high weight on the red weight map (e.g., 305 of FIG. 3) due to its proximity to center pixel 410 or the ALS. In contrast, a display pixel 435 that is further away from center pixel 410, but that also includes a similar measure of red components, will have a lower weight on red weight map 305 primarily in part due to its further distance from center pixel 410. Note that in some aspects, display pixels proximal to the ALS may be included in a region 411 of the pixel weighting maps and a relative ALS intensity response may be inversely proportional to a distance of a selected display pixel from the center pixel location.

In embodiments, after the RGB components (301A, 301B, 301C), are multiplied by a corresponding pixel weight from respective weight maps 305, 307, and 309, results are summed for each of the red channel, green channel, and blue channels to determine a substantially total display leakage component.

Figure 4:
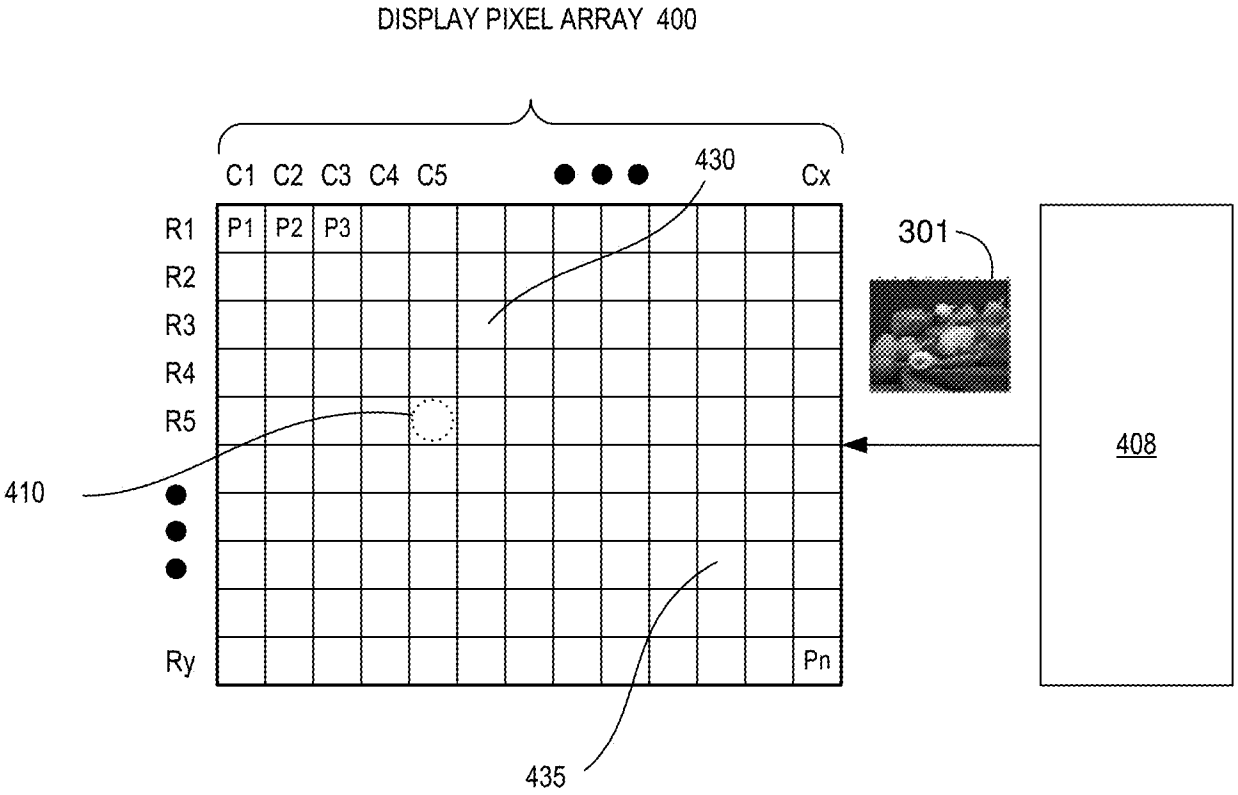
FIG. 4 illustrates a display pixel array associated with the example process of FIG. 3, in accordance with aspects of the disclosure.
Figure 5B:
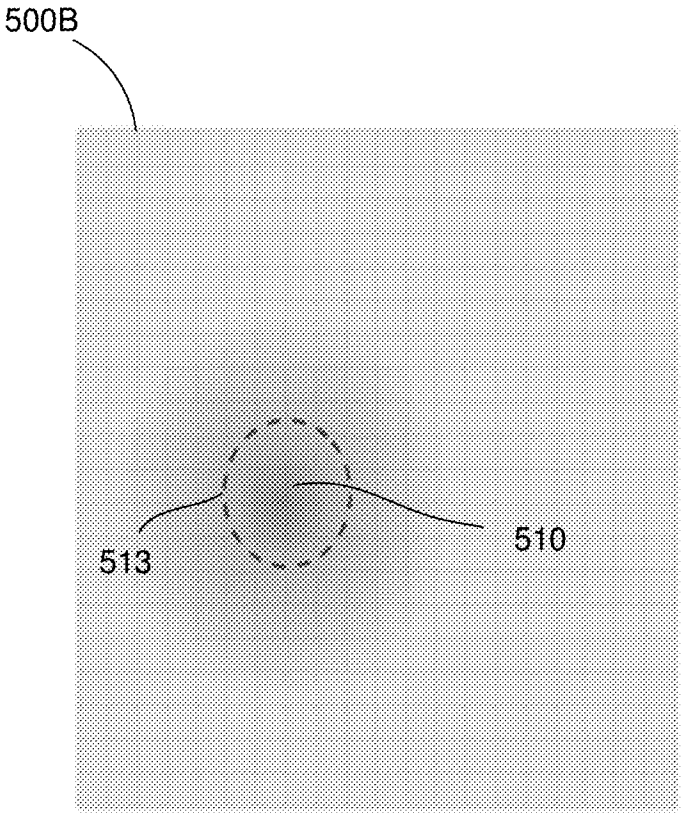
FIGS. 5A and 5B illustrate a respective display pixel array and associated pixel weighting map, in accordance with aspects of the disclosure.
Figure 5A:
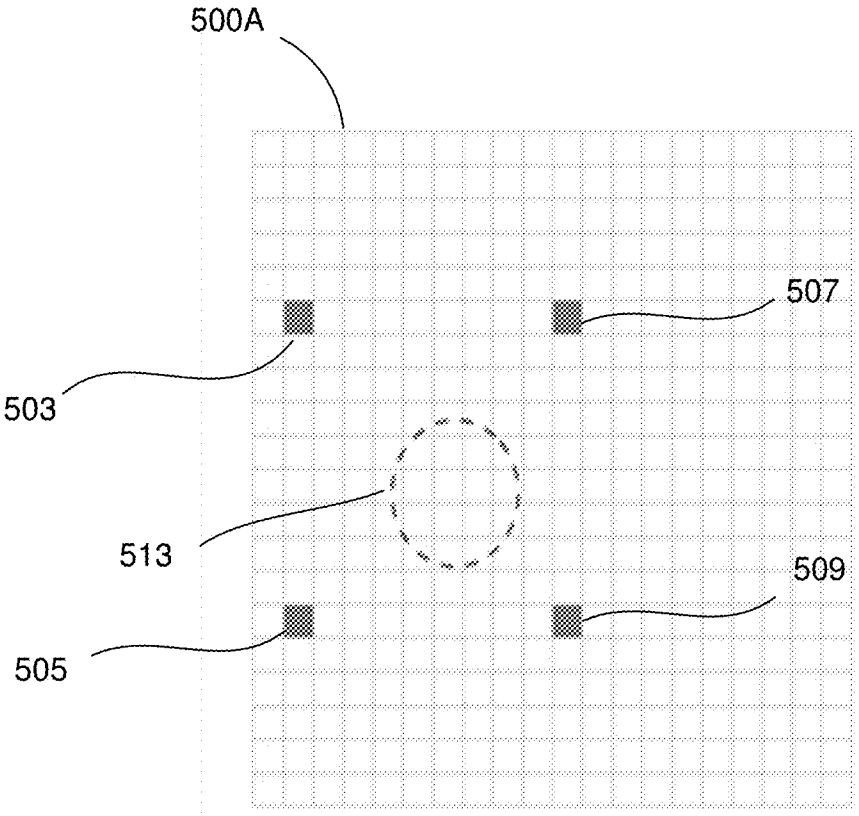

FIGS. 5A and 5B illustrate a respective simplified display pixel array and associated pixel weighting map, in accordance with aspects of the disclosure. FIGS. 5A and 5B illustrate a calibration method associated with generating the pixel weighting maps of FIG. 3. In embodiments, prior to generating the pixel weighting maps, a center pixel (e.g., center pixel 410 of FIG. 4) behind which the ALS is disposed in the display pixel array is identified.

For example, in embodiments, the method may include illuminating a first pixel 503, a second pixel 505, a third pixel 507, and a fourth pixel 509 during a respective first time period, second time period, third time period, and a fourth time period. The calibration includes generating by the ALS, during each successive time period, respective first, second, and third and fourth light measurements. In embodiments, the method includes identifying a center pixel of the display (e.g., a center pixel located in a region 511) from at least the first, second, third, and fourth light measurements. In embodiments, the method may be repeated for a plurality of pixels of the display pixel array. In some aspects of the disclosure, a Gaussian model is fit over the light measurements indicating the relative ALS intensity responses to the display pixels to find a center pixel location over the ALS, e.g., a pixel 510 within a high probability region 513. In embodiments, the ALS is disposed directly behind the center pixel location.

Figure 6:
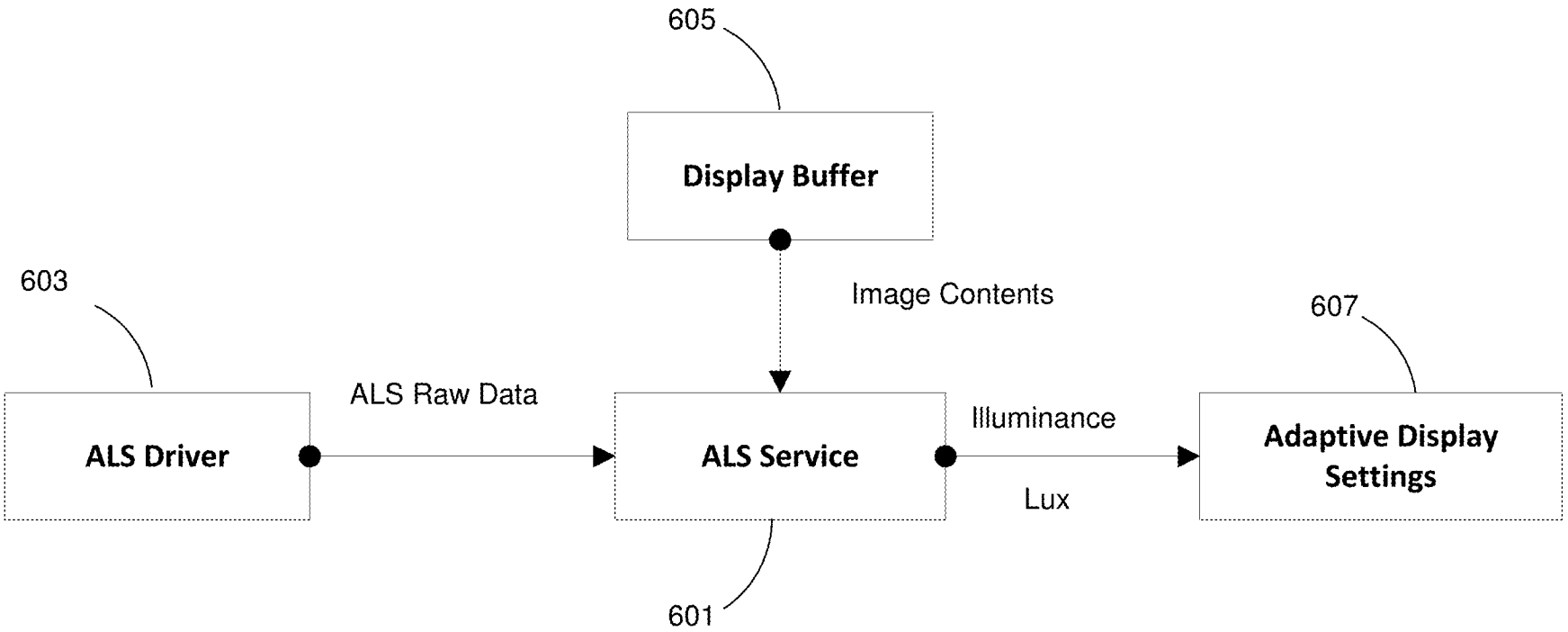
FIG. 6 is a block diagram illustrating a process associated with generating an ambient light measurement, in accordance with aspects of the disclosure.
Figure 7:
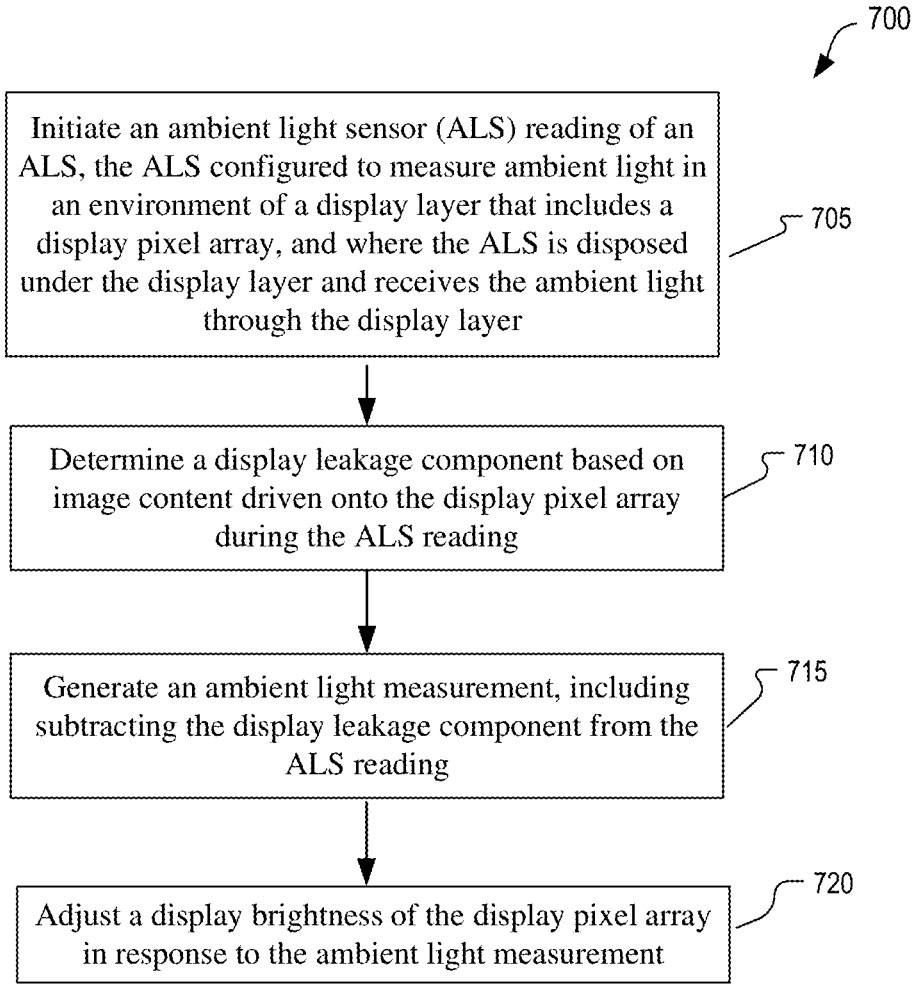
FIG. 7 is a flow diagram associated with the process of FIG. 6, in accordance with aspects of the disclosure.

FIGS. 6 and 7 are described in conjunction to provide an overview of a process associated with generating an ambient light measurement, in accordance with aspects of the disclosure. FIG. 6 is a block diagram 600 including the elements of ALS Service block 601, an ALS Driver block 603, a Display Buffer block 605, and an Adaptive Display Settings block 607. FIG. 7 is a flow diagram that describes a process 700 that may be performed by elements of FIG. 6. For example, at process block 705 of FIG. 7, process 700 includes initiating by, e.g., ALS service 601, an ambient light sensor (ALS) reading of an ALS.

Note that the order in which some or all of the blocks/process blocks appear in FIGS. 6 and 7 should not be deemed limiting. Rather, one of ordinary skill in the art having the benefit of the present disclosure will understand that some of the process blocks may be executed in a variety of orders not illustrated, or even in parallel.

In some aspects of the disclosure, ALS Service block 601 includes processing logic (further discussed below) which may be coupled to a memory to perform various elements of process 700. In embodiments, the ALS is configured to measure ambient light in an environment of a display layer that includes a display pixel array, and the ALS is disposed under the display layer and receives the ambient light through the display layer. In embodiments, ALS Driver block 603 and Display Buffer block 605 are configured to provide ALS Service block 601 with inputs to allow ALS Service block 601 to generate the ambient light measurement.

For example, ALS Driver block 603 is configured to provide an ALS raw data reading of ambient light to ALS service block 601 and Display Buffer 605 is configured to provide ALS Service block 601 with image contents to be driven onto the display pixel array.

At process block 710, ALS service block 601 determines a display leakage component based on image content driven onto the display pixel array during the ALS reading. In implementations, ALS service block 601 analyzes the image contents to determine RGB components that are to be driven onto display pixels of the display pixel array.

As discussed with respect to FIGS. 3 and 4, in some aspects, determining the display leakage component includes applying pixel weighting maps that map a relative intensity of light sensed by the ALS sensor from each pixel and then multiplying the relative intensity of light by the RGB components of the image content. In embodiments, calibration and generation of the pixel weighting maps is discussed in connection with FIGS. 5A, 5B, and 6. In some implementations, as described in connection with FIGS. 5A, 5B, and 6, the process includes, in part, calibrating the pixel weighting maps to find a center pixel.

At process block 715, process 700 includes generating by the ALS service, an ambient light measurement by subtracting the display leakage component from the ALS reading. Accordingly, referring to FIG. 4, if an image is completely red (e.g., a single red pepper) in display pixels proximate to the ALS, a red component is subtracted from the raw data ambient light reading to result in a corrected or more accurate ambient light measurement.

Finally, in implementations, adaptive display settings block 720 receives the ambient light measurement and subsequently adjusts a display brightness of the display pixel array in response to the ambient light measurement.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

The term "processing logic" (e.g., as discussed in connection with FIG. 6) in this disclosure may include one or more processors, microprocessors, multi-core processors, Application-specific integrated circuits (ASIC), and/or Field Programmable Gate Arrays (FPGAs) to execute operations disclosed herein. In some embodiments, memories (not illustrated) are integrated into the processing logic to store instructions to execute operations and/or store data. Processing logic may also include analog or digital circuitry to perform the operations in accordance with embodiments of the disclosure.

A "memory" or "memories" (e.g., as discussed in connection with FIG. 6) described in this disclosure may include one or more volatile or non-volatile memory architectures. The "memory" or "memories" may be removable and non-removable media implemented in any method or technology for storage of information such as computer-readable instructions, data structures, program modules, or other data. Example memory technologies may include RAM, ROM, EEPROM, flash memory, CD-ROM, digital versatile disks (DVD), high-definition multimedia/data storage disks, or other optical storage, magnetic cassettes, magnetic tape, magnetic disk storage or other magnetic storage devices, or any other non-transmission medium that can be used to store information for access by a computing device.

A Network may include any network or network system such as, but not limited to, the following: a peer-to-peer network; a Local Area Network (LAN); a Wide Area Network (WAN); a public network, such as the Internet; a private network; a cellular network; a wireless network; a wired network; a wireless and wired combination network; and a satellite network.

Communication channels may include or be routed through one or more wired or wireless communication utilizing IEEE 802.11 protocols, BlueTooth, SPI (Serial Peripheral Interface), I2C (Inter-Integrated Circuit), USB (Universal Serial Port), CAN (Controller Area Network), cellular data protocols (e.g. 3G, 4G, LTE, 5G), optical communication networks, Internet Service Providers (ISPs), a peer-to-peer network, a Local Area Network (LAN), a Wide Area Network (WAN), a public network (e.g. "the Internet"), a private network, a satellite network, or otherwise.

In embodiments, a display including, e.g., display pixel array 200 of FIG. 2, may be included in or coupled to a computing device. A computing device may include a desktop computer, a laptop computer, a tablet, a phablet, a smartphone, a feature phone, a server computer, or otherwise. A server computer may be located remotely in a data center or be stored locally.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible non-transitory machine-readable storage medium includes any mechanism that provides (i.e., stores) information in a form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A method comprising:

initiating an ambient light sensor (ALS) reading of an ALS, wherein the ALS is configured to measure ambient light in an environment of a display layer that includes a display pixel array, and wherein the ALS is disposed under the display layer and receives the ambient light through the display layer, determining a display leakage component based on image content driven onto the display pixel array during the ALS reading;

generating an ambient light measurement, wherein generating the ambient light measurement includes subtracting the display leakage component from the ALS reading; and adjusting a display brightness of the display pixel array in response to the ambient light measurement, wherein the display leakage component is determined based on a pixel weighting map that maps a relative ALS intensity response to pixels proximate to the ALS and the pixel weighting map is calibrated by: successively illuminating each of a selected plurality of the pixels, taking a respective light measurement during each illumination; and analyzing the respective light measurements to identify a center pixel location over the ALS.

2. The method of claim 1, wherein the determining the display leakage component based on image content driven onto the display pixel array during the ALS reading includes:

determining red, green, and blue components of the image content driven onto pixels of the display pixel array;

multiplying each of the red, green, and blue components of the image content by a corresponding weight from a corresponding pixel weighting map; and summing the results for each of the red, green, and blue components to determine the display leakage component for each of a red channel, green channel, and blue channel.

3. The method of claim 1, wherein building the pixel weighting map includes fitting a Gaussian model over light measurements indicating the relative ALS intensity responses, to find the center pixel location over the ALS.

4. The method of claim 1, wherein the relative ALS intensity response is inversely proportional to a distance of a selected pixel from the center pixel location.

5. The method of claim 1, wherein the display pixel array is included in an organic light-emitting diode (OLED) display.

6. The system of claim 1, wherein the display pixel array is an organic light-emitting diode (OLED) display.

7. A system comprising:

a display layer including a display pixel array for generating image light;

an ambient light sensor (ALS) to measure ambient light in an environment of the display layer, wherein the ALS is disposed under the display layer and wherein the ALS receives the ambient light through the display layer; and processing logic configured to:

initiate an ALS reading of the ALS;

determine a display leakage component based on image content driven onto the display pixel array during the ALS reading;

generate an ambient light measurement, wherein generating the ambient light measurement includes subtracting the display leakage component from the ALS reading; and adjusting a display brightness of the display pixel array in response to the ambient light measurement, wherein the display leakage component is determined based on each of a red, green, and blue pixel weighting map that maps a relative ALS intensity response and the red, green, and blue pixel weighting maps are calibrated by: successively illuminating each of a selected plurality of pixels; taking a respective light measurement during each illumination; and analyzing the respective light measurements to identify a center pixel location over the ALS.

8. The system of claim 7 wherein the processing logic is configured to determine the display leakage component by:

multiplying red, green, and blue components of the image content by a corresponding weight from a corresponding pixel weighting map; and summing the results for each of the red, green, and blue components to determine the display leakage component for each of a red channel, green channel, and blue channel.

9. The system of claim 8 wherein the processing logic is configured to, prior to the determine of the display leakage component, receive image content from a display buffer and to analyze the image content driven onto display pixels of the display pixel array.

10. The system of claim 7, further comprising fitting a Gaussian model over the light measurements to identify the center pixel location.

11. A display comprising:

a display layer including a display pixel array for generating image light; and an ambient light sensor (ALS) to measure ambient light in an environment of the display, wherein the ALS is disposed under the display layer and wherein the ALS receives the ambient light through the display layer;

wherein the display layer is coupled to implement an adaptive display setting received from an ALS service, wherein the adaptive display setting is generated from an ambient light measurement, the ambient light measurement determined by subtracting a display leakage component from an ALS reading to compensate for light leakage from pixels of the display pixel array, wherein the display leakage component is based on a pixel weighting map generated from a relative ALS intensity response to pixels proximate to the ALS and the ALS service is to calibrate the pixel weighting map by illumination of each of a selected plurality of the pixels during successive time periods and analysis of intensity measurements taken during the time periods to identify a center pixel location over the ALS.

12. The display of claim 11, further comprising a display buffer including image contents, wherein red, green, and blue components of the image content are to be driven onto display pixels of the display pixel array and are to be used in generating the ambient light measurement.

13. The display of claim 12, further comprising the ALS service, wherein the ALS service is configured to:

determine the red, green, and blue components of the image content driven onto pixels of the display pixel array;

multiply each of the red, green, and blue components of the image content by a corresponding weight from a corresponding pixel weighting map; and sum results for each of the red, green, and blue components to determine the display leakage component for each of a red channel, green channel, and blue channel.

14. The display of claim 11, wherein the ALS service is further to fit a Gaussian model over a plurality of selected ALS intensity measurements to identify the center pixel location.

15. The display of claim 14, wherein the display is an organic light-emitting diode (OLED) display.

* * * * *